US008206028B2

(12) United States Patent
Okuda

(10) Patent No.: US 8,206,028 B2
(45) **Date of Patent: *Jun. 26, 2012**

(54) PORTABLE DEVICE AND PORTABLE WATCH

(75) Inventor: Hideki Okuda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/592,427

(22) Filed: Nov. 24, 2009

(65) Prior Publication Data

US 2010/0128575 A1 May 27, 2010

(30) Foreign Application Priority Data

Nov. 26, 2008 (JP) ..... 2008-300718

(51) Int. Cl.
*G04B 29/00* (2006.01)

(52) U.S. Cl. ..... 368/319; 368/295; 368/306

(58) Field of Classification Search ..... 368/294–296, 368/306–308, 319–321
See application file for complete search history.

(56) References Cited

U.S. PATENT DOCUMENTS 3,548,588 A * 12/1970 Piquerez Ervin ..... 368/294
4,420,264 A * 12/1983 Murata ..... 368/223
5,742,565 A * 4/1998 Cuinet et al. ..... 368/190
6,210,034 B1 * 4/2001 Latini ..... 368/289
6,379,037 B1 * 4/2002 Saleh et al. ..... 368/185
6,679,624 B1 * 1/2004 Mouawad ..... 368/216
6,872,899 B2 * 3/2005 Oshio et al. ..... 200/43.13
7,434,984 B2 * 10/2008 Hiranuma et al. ..... 368/295
7,494,270 B2 * 2/2009 Hiranuma et al. ..... 368/288
2004/0100869 A1 * 5/2004 Finazzi ..... 368/1
2005/0254353 A1 * 11/2005 Cogoli et al. ..... 368/281

OTHER PUBLICATIONS

Patent Abstracts of Japan, Publication No. 2003-007164, Publication Date Jan. 10, 2003.

* cited by examiner

*Primary Examiner* — Sean Kayes
(74) *Attorney, Agent, or Firm* — Adams & Wilks

(57) ABSTRACT

A portable device, such as a wristwatch, has a push-button that includes an engaging portion, and the push-button is mounted on a watch sheath. A stopper is arranged on the watch sheath. The stopper is movable between a locked position in which the push-button is held at a predetermined position by engagement with the engaging portion and an unlocked position in which the operation of the push-button is allowed. A circular operating ring surrounds an hour plate mounted on the watch sheath and is rotatably mounted on the watch sheath from the front side thereof. The movement of the stopper between the locked position and the unlocked position is interlocked with the rotating operation of the operating ring.

16 Claims, 14 Drawing Sheets

PORTABLE DEVICE AND PORTABLE WATCH

BACKGROUND OF THE INVENTION

The present invention relates to a portable device and a portable watch having a configuration in which an operating member such as a push button or a winder can be restrained so as not to be moved accidentally in a push-pull direction when not in use.

DESCRIPTION OF THE PRIOR ART

Portable devices such as portable watches including wristwatches and pocket watches, stop watches, mobile phones, and portable information terminals include those having a push button for moving a contact point or the like in a device sheath mounted on the device sheath. By pushing the push button, in the case of a quartz portable watch, for example, a time display can be switched from an analogue display to a digital display, or the date or the day of the week displayed in digital can be corrected.

In the related art, in the portable devices of this type, for example, in the case of a wristwatch, in order to prevent the push button from being pushed accidentally, a female screw portion formed on an inner periphery of a cylindrical locking member is screwed onto a male screw portion formed on an outer periphery of a pipe mounted on a body of the device sheath, and the locking member is provided so as to be movable between a locked position and a lock waiting position according to the change of the screwed position of these screw portions. Also, the shape of the push button inserted into the pipe is circle in front view so as not to interfere a rotating operation of the cylindrical locking member.

Since a restraining portion of the locking member is apart from a head portion of the push button penetrated through the pipe in a state in which the locking member is arranged at the lock waiting position, the pushing operation of the push button is allowed in a stroke corresponding to the distance therefrom. In contrast, since the restraining portion is in a state of coming into contact with the head portion of the pushbutton in a state in which the locking member is arranged at the locked position, the pushing operation of the push button is restrained.

In the technology disclosed in Patent Document, JP-A-2003-7164 (Paragraph 0002 to 0006, Paragraph 0026 to 0038 FIG. 1 to FIG. 3), the locking member is formed of a cylinder having a diameter which matches the push button, and the locking member has such a small diameter as a diameter equal to or smaller than the thickness of the device sheath, for example. Therefore, the locking member can hardly be held from the lateral side of the device sheath, and the workability when rotating the locking member is not good. In particular, when it is implemented as a wristwatch, the locking member can hardly be operated in a state in which the wristwatch is worn on a wrist of a human body.

SUMMARY OF THE INVENTION

It is an object of the present invention is to provide a portable device and a portable watch in which an operation to restrain an operating member such as a push button so as to avoid an accidental movement of the operating member when not in use and an operation to release this restraint are achieved easily.

A portable device according to the present invention includes an operating member having an engaging portion mounted on a device sheath, a stopper moved between a locked position in which the operating member is restrained at a predetermined position by the engagement with the engaging portion and an unlocked position in which an operation of the operating member is allowed, the stopper being arranged on the device sheath, and a circular operating ring surrounding a display portion mounted on the device sheath and being mounted on the device sheath from the front side thereof so as to allow a rotating operation, and is characterized in that the movement of the stopper between the locked position and the unlocked position is interlocked with the rotating operation of the operating ring.

In the present invention, the operating member represents a push button pushed along the axial direction thereof or a push-pull winder of a watch or the like which is rotated in a state of being pulled along the axial direction. In the present invention, the predetermined position represents a position in which the push button is arranged in a waiting state which allows the push button to be pushed in if the operating member is the push button, and a position in which the winder is arranged in a waiting state which allows the winder to be pulled out if the operating member is the winder. In addition, the operating member arranged at the predetermined position is in the state not in use.

In the present invention, the device sheath represents an outer case in which driving components of the portable device are stored and, if the portable device is, for example, a portable watch such as a wristwatch or a pocket watch, it represents an outer case in which driving components such as a watch movement are stored. In the present invention, the display portion is not limited to time display, but may be those on which various data are displayed as an image such as a still image or a moving image, and the display portion preferably has a circular shape, but does not necessarily have to have the circular shape.

In the present invention, the operating ring may be provided in such a manner that at least a peripheral portion thereof is exposed so as to allow a user to place his or her fingers. When the entire surface of the operating ring is exposed, it is preferable in that a display which serves as a marker of the rotating operation can be provided on the surface thereof in a larger size, and a hooked portion for the rotating operation can also be provided as needed.

In the present invention, by rotating the circular operating ring rotatably mounted on the device sheath from the front side of the device sheath, the stopper can be arranged at the locked position or the unlocked position in conjunction therewith. Since the stopper arranged at the locked position is able to engage with the engaging portion of the operating member, the operating member is restrained so as not to be moved from the predetermined position by this engagement, and an erroneous operation of the operating member is prevented. Since the stopper arranged at the unlocked position is released from the engaging portion of the operating member, by pushing or pulling the push button or the push-pull operating member in the axial direction in this state, the operating member can be moved from the predetermined position.

Since the operating ring surrounds the display mounted on the device sheath, it is significantly larger than the operating member, and hence the operating ring can easily be rotated by gripping the same. In addition, since the operating ring is operated from the front side of the device sheath, for example, in the implementation in the wristwatch, even though the wristwatch is worn on the wrist of the human body, the operation is rarely hindered by the wrist. Therefore, the operation to restrain the operating member such as the push button so that the operating member is not moved accidentally when not in use and the operation to release this restraint are achieved easily.

Also, the portable device according to the present invention includes a an operating member having an engaging portion mounted on a device sheath, a locking member having an elastically deformable stopper moved between a locked position in which the operating member is restrained at a predetermined position by the engagement with the engaging portion and an unlocked position in which the operation of the operating member is allowed, the stopper being arranged on the device sheath, and a circular operating ring surrounding a display portion mounted on the device sheath and being mounted on the device sheath from the front side thereof so as to allow a rotating operation, and is characterized in that the stopper is brought into contact with a back surface of the operating ring so that the movement of the stopper between the locked position and the unlocked position is interlocked with the rotating operation of the operating ring.

In the present invention, the locking member having the stopper is preferably formed of a leaf spring, but the invention is not limited thereto.

In the present invention, by rotating the circular operating ring rotatably mounted on the device sheath from the front side of the device sheath, the stopper of the locking member can be arranged at the locked position or the unlocked position using its own elasticity in conjunction therewith. Since the stopper arranged at the locked position is able to engage with the engaging portion of the operating member, the operating member is restrained so as not to be moved from the predetermined position by this engagement, and the erroneous operation of the operating member is prevented. Since the stopper arranged at the unlocked position is released from the engaging portion of the operating member, by pushing or pulling the operating member in the axial direction in this state, the operating member can be moved from the predetermined position.

Since the operating ring surrounds the display mounted on the device sheath, it is significantly larger than the operating member, and hence the operating ring can easily be rotated by gripping the same. In addition, since the operating ring is operated from the front side of the device sheath, for example, in the implementation in the wristwatch, even though the wristwatch is worn on the wrist of the human body, the operation is rarely hindered by the wrist. Therefore, the operation to restrain the operating member such as the push button so as to avoid the accidental movement of the operating member when not in use and the operation to release this restraint are achieved easily.

A portable device according to the present invention includes a device sheath having a through hole and a communication hole communicating with the through hole respectively formed thereon, a display portion mounted on the device sheath, a pipe inserted into the through hole and fixed to the device sheath, an operating member having a shaft portion slidably inserted into the pipe, an operating head provided at one end of the shaft portion and inserted into the through hole, and an engaging portion formed on the operating head, a circular operating ring formed into a size surrounding the display portion, having a locking surface which can oppose the communication hole and an unlocking recess opening on the locking surface, and being rotatably mounted on the device sheath from the front side of the sheath, and a locking member having a stopper mounted on the device sheath and moved between a locked position which allows engagement of the engaging portion and an unlocked position being apart from the engaging portion by being elastically deformed according to the locking surface and the unlocking recess and inserted into of removed from the through hole via the communication hole in association with the elastic deformation.

In the present invention, the operating head of the operating member such as the push button may be integral with the shaft portion or may be formed separately and connected to the shaft portion.

In the present invention, by rotating the circular operating ring rotatably mounted on the device sheath from the front side of the device sheath, the stopper can be arranged at the locked position or the unlocked position in conjunction with the elastically deformable stopper of the locking member.

In other words, in a state in which the locking surface of the rotated operating ring comes into contact with the stopper of the locking member, the stopper is pressed by the locking surface against its own elasticity and is arranged at the locked position. Since the stopper arranged at the locked position is able to engage with the engaging portion of the operating member, the operating member is restrained so as not to be moved from the predetermined position by this engagement, and the erroneous operation of the operating member is prevented. Also, in a state in which the locking surface of the rotated operating ring is released from the stopper and the unlocking recess opposes the stopper, the stopper enters the unlocking recess by its own elasticity and is arranged at the unlocked position. Accordingly, since the stopper of the locking member is released from the engaging portion of the operating member, by operating the operating member in the axial direction in this state, the operating member can be moved from the predetermined position.

Since the operating ring surrounds the display mounted on the device sheath, it is significantly larger than the operating member. Therefore, the operating ring can easily be rotated by gripping the same. In addition, since the operating ring is operated from the front side of the device sheath, for example, in the implementation in the wristwatch, even though the wristwatch is worn on the wrist of the human body, the operation is rarely hindered by the wrist. Therefore, the operation to restrain the operating member such as the push button so as to avoid an accidental movement of the operating member when not in use and the operation to release this restraint are achieved easily.

A preferred mode of the portable device according to the present invention is characterized in that the operating member is the push button, and the pushing operation of the push button is prevented by the stopper arranged at the locked position.

In this configuration of the present invention, there is provided the portable device in which the operation to restrain the push button so as to avoid the accidental movement of the push button when not in use and the operation to release this restraint are achieved easily. Furthermore, since the push button is arranged at a position separate from the operating ring and hence does not constrain the rotation of the operating ring, preferably, the shape of the push button in front view is not limited to a circular shape, and the shape in front view may be an arbitrary shape including non-circular shapes according to the design of the portable device.

A preferable mode of the portable device according to the present invention is characterized in that the shape of the operating head of the push button in front view is a non-circular shape.

In this configuration of the present invention, there is provided the portable device in which even though the shape of the operating head of the push button in front view is a non-circular shape, the push button can be restrained so as not to be operated accidentally when not in use.

A preferable mode of the portable device according to the present invention is characterized in that the locking member is a leaf spring.

In this configuration of the present invention, since the leaf spring is thin, it is preferable in that the thickness of the device sheath is hardly increased, and the locking member having the elastically deformable stopper can advantageously be manufactured easily by punching with a press machine.

A preferable mode of the portable device according to the present invention is characterized in that the locking member includes an elastically deformable detent strip projecting toward the operating ring at a position different from the stopper, the operating ring is provided on the back surface thereof with a detent groove which allows the detent strip to be inserted therein and removed therefrom in association with the rotation of the operating ring and allows the detent strip to be engaged therewith in a state in which the stopper is arranged at the locked position.

In this configuration of the present invention, since the detent strip of the locking member engages with the detent groove of the operating ring in a state in which the stopper of the locking member is arranged at the locked position in association with the rotating operation of the operating ring, the operating ring can be held temporarily by the click-stop action. In addition, it is preferable in that the user is notified that the stopper of the locking member is placed at the locked position by the feeling of detent provided by the click-stop operation and the sounds generated in association with the detent.

A preferable mode of the portable device according to the present invention is characterized in that there is provided a click-stop mechanism which holds the operating ring temporarily in a state in which the stopper is arranged at the locked position.

In this configuration of the present invention, in a state in which the stopper of the locking member is arranged at the locked position in association with the rotating operation of the operating ring, the click-stop mechanism performs the click-stop action to hold the operating ring temporarily. In addition, it is preferable in that the user is notified that the stopper of the locking member is placed at the locked position by the feeling of detent provided by the click-stop operation and the sounds generated in association with the detent.

The portable watch according to the present invention is characterized by being configured with the portable devices according to the respective inventions.

Since the portable watch according to the present invention is configured with the portable devices in the respective inventions, the operation to restrain the operating member such as the push button to a predetermined position so that the push button is not operated accidentally when not in use and the operation to release this restraint are achieved easily.

A preferred mode of the portable device according to the present invention is a portable watch configured with portable devices of the respective inventions, and is characterized in that a winder of the portable watch constitutes a push-pull operating member, and the pulling operation of the winder is prevented by the stopper arranged at the locked position.

In this configuration of the present invention, since the operating ring surrounds the display mounted on the device sheath, it is significantly larger than the winder. Therefore, the operating ring can easily be rotated by gripping the same. In addition, since the operating ring is operated from the front, side of the device sheath, even though the wristwatch is worn on the wrist of the human body, the operation is rarely hindered by the wrist. Therefore, an operation to restrain the winder from being pulled out accidentally when not in use and an operation to release this restraint are easily achieved.

ADVANTAGE OF THE INVENTION

According to the present invention, there are provided a portable device and a portable watch in which an operation to restrain an operating member such as a push button from being moved accidentally when not in use and an operation to release this restraint are achieved easily.

DETAILED DESCRIPTION OF THE EMBODIMENTS

Referring now to FIG. 1 to FIG. 8, a first embodiment of the present invention will be described.

Figure 1:
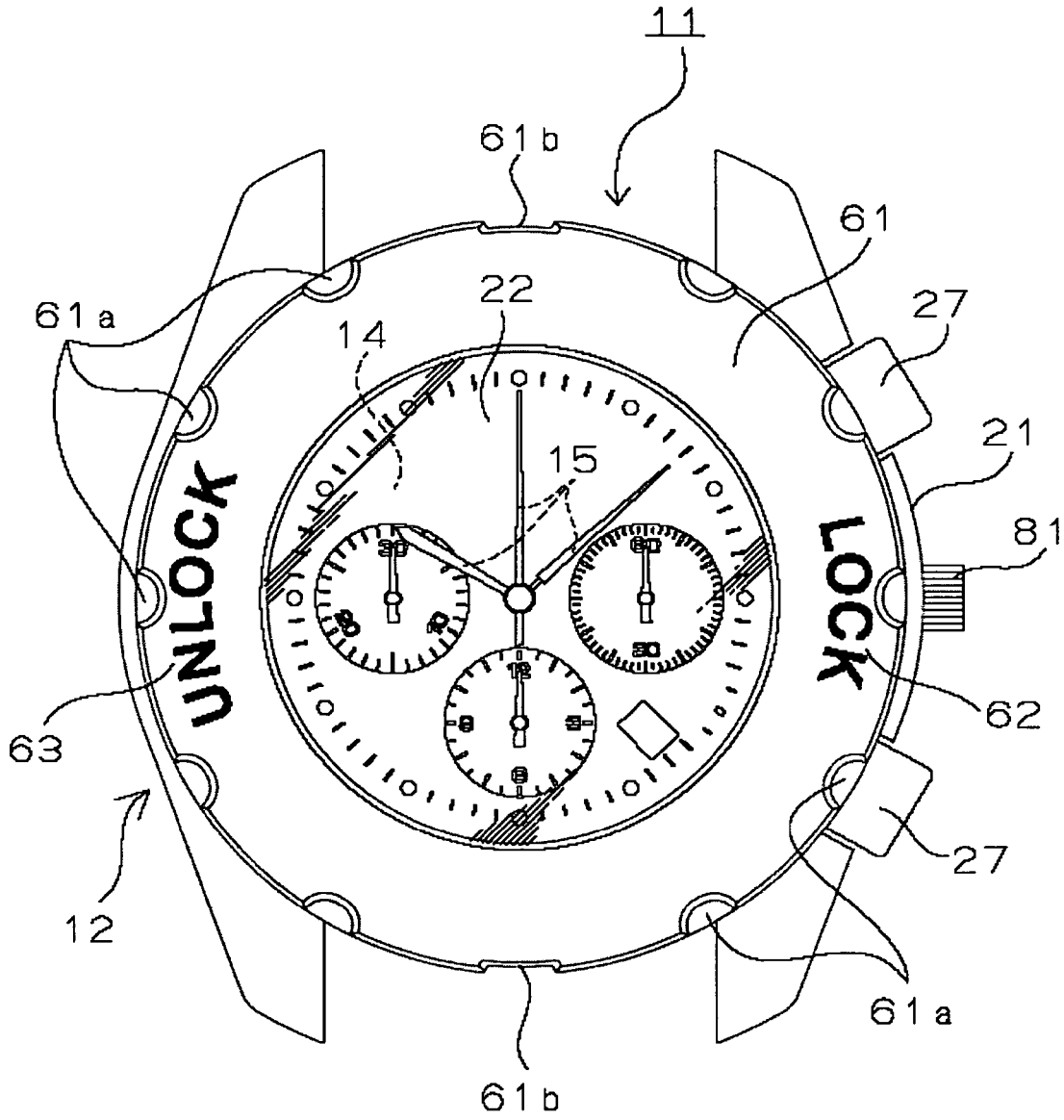
FIG. 1 is a front view showing a wristwatch according to a first embodiment of the present invention.
Figure 2:
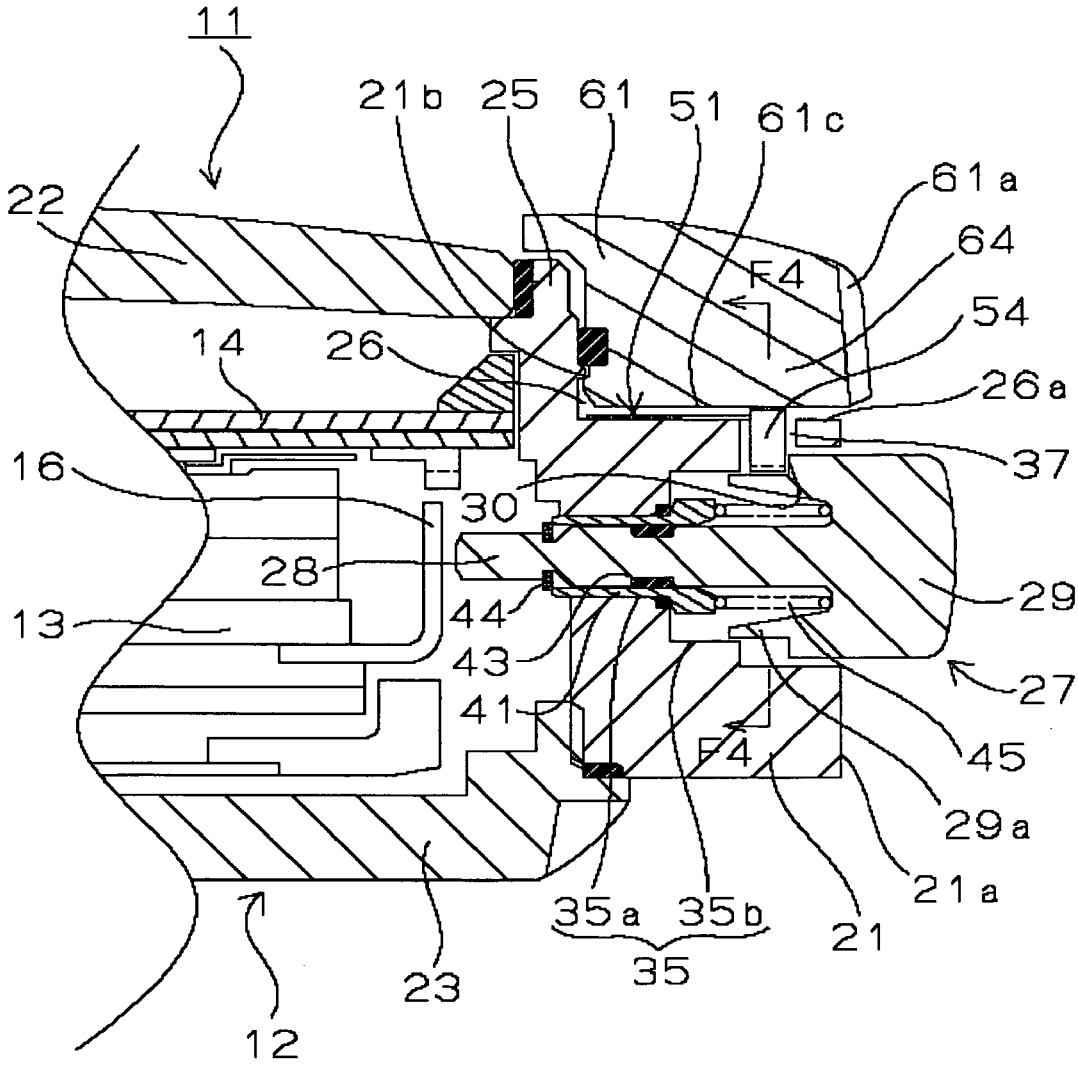
FIG. 2 is a cross-sectional view of a mounting portion of a push button of the wristwatch in FIG. 1 in a state in which the push button is locked.
Figure 3:
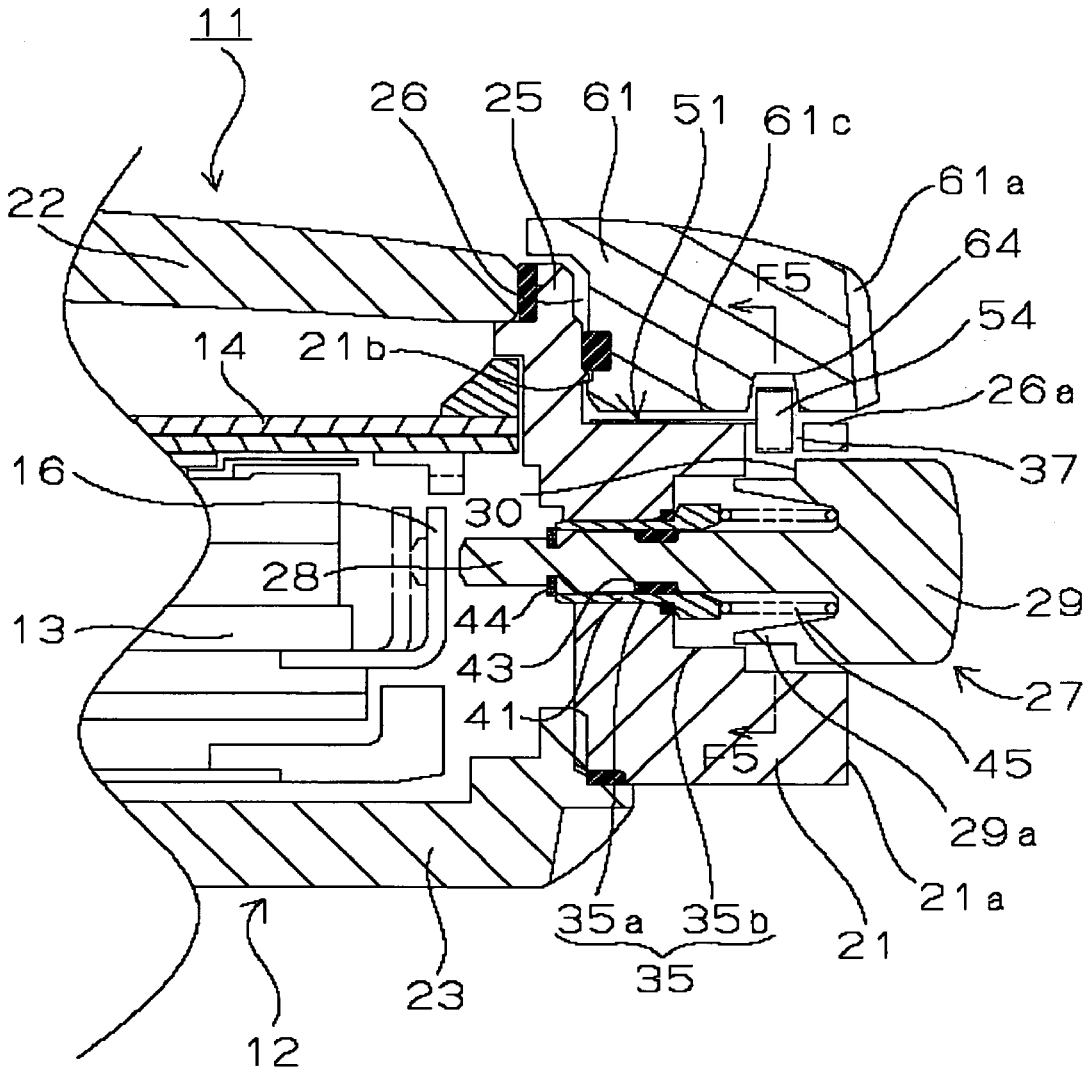
FIG. 3 is a cross-sectional view of the mounting portion of the push button of the wristwatch in FIG. 1 in a state in which the push button is unlocked.

Reference numeral 11 in FIG. 1 to FIG. 3 designates a portable device, for example, a portable watch, and more specifically, a wristwatch. A watch sheath (case) 12 of the wristwatch 11, which constitutes a device sheath or case, includes a built-in component, for example, a watch movement 13 integrated therein, and a display portion, for example, a circular hour plate 14 is mounted thereon. The display of the hour plate 14 is indicated by time display hands 15 such as an hour hand, a minute hand, and a second hand driven by the watch movement 13.

The watch movement 13 includes a contact point 16 (see FIG. 2 and FIG. 3) formed of a leaf spring or the like. When the contact point 16 is pressed by a push button, described later, the function of the watch movement 13 is changed over.

The watch sheath 12 is formed by mounting a glass 22 for allowing a viewer to see the hour plate 14 therethrough on a surface of a body 21 which constitutes a sheath body formed of a metal such as stainless steel or titanium or a synthetic resin into an annular shape on one side in terms of the thickness direction in a liquid-tight manner, and mounting a back lid 23 formed of a metal or a synthetic resin on a surface of the body 21 on the other side in terms of the thickness direction in an water-tight manner.

As shown in FIG. 2 and FIG. 3, the body 21 includes an annular projection 25 and a ring arrangement groove 26 on a front portion (upper surface portion) thereof. The annular projection 25 has a circular shape, and the glass 22 is mounted on an inner peripheral surface thereof. The ring arrangement groove 26 is provided so as to surround the annular projection 25, and is opened upward and sideward of the body 21. A bottom surface 26*a* of the ring arrangement groove 26 is formed into a horizontal plane.

The body 21 is provided with a push-pull operating member, for example, a winder 81 (see FIG. 1 and FIG. 6) mounted thereon, and other operating members, for example, push buttons 27 mounted thereon. The push buttons 27 are provided, for example, at positions shifted from the winder 81 toward 12 o'clock side, and 6 o'clock side, respectively. Since the configurations of the push buttons 27 and the mounting configurations to the body 21 are the same, one of them will be described below referring to FIG. 2, FIG. 3, and so on.

The body 21 is formed with a through hole 35 penetrated through the body 21 in the radial direction at a position shifted from the annular projection 25 and the ring arrangement groove 26 toward a backside of the body 21. The through hole 35 includes a pipe mounting hole 35*a* and a head insertion hole 35*b* continued therefrom.

The pipe mounting hole 35*a* is a circular hole and is opened at one end thereof to an interior of the body 21, that is, to an interior of the watch sheath 12. The other end of the pipe mounting hole 35*a* is opened to the head insertion hole 35*b*. The head insertion hole 35*b* has a diameter larger than that of the pipe mounting hole 35*a*, and is, for example, a square hole. The head insertion hole 35*b* opens to an outer surface 21*a* of the body (outer surface of the sheath).

Figure 6:
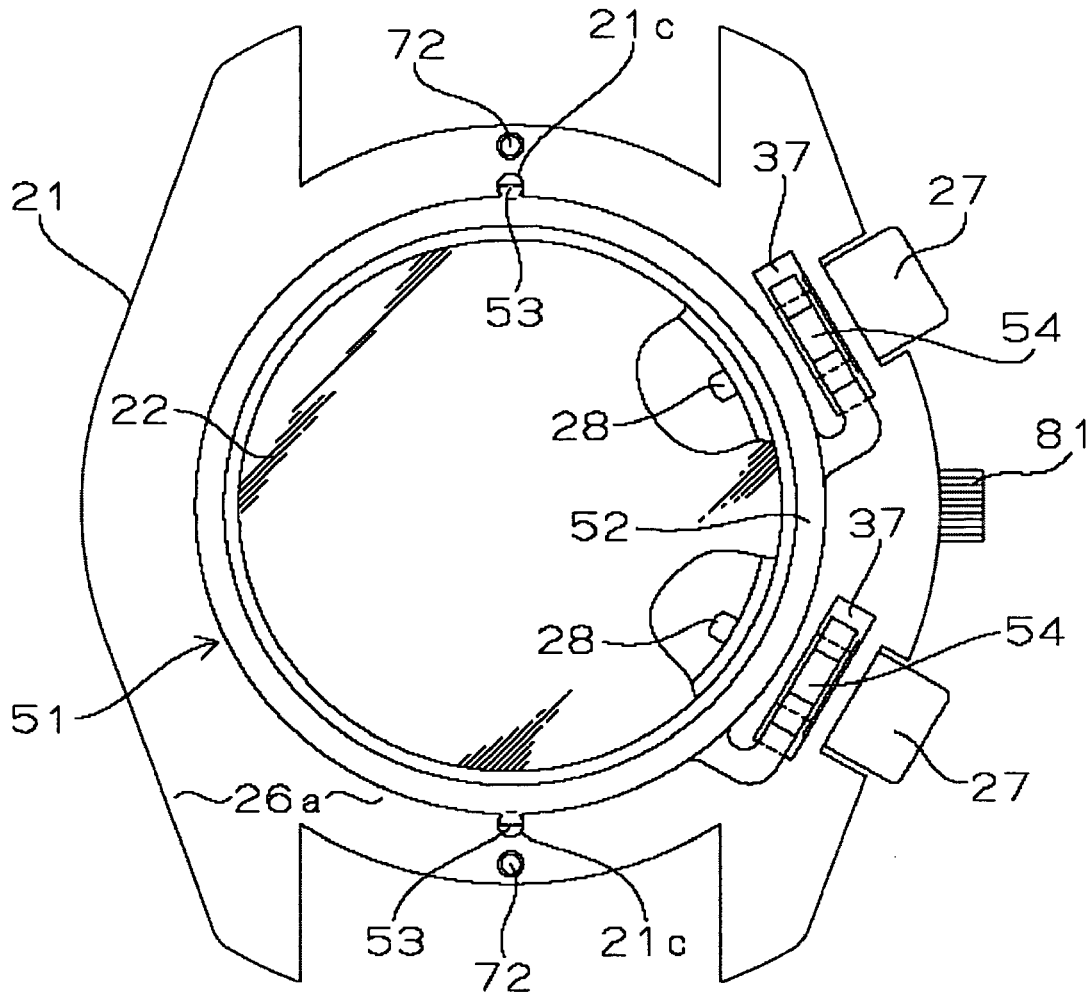
FIG. 6 is a front view, partly broken, of the wristwatch in FIG. 1 in a state in which an operating ring thereof is removed.

A communication hole 37 is formed on the body 21 so as to communicate with the head insertion hole 35*b*. As shown in FIG. 6 and so on, the communication hole 37 is a narrow square hole, and an upper end thereof is opened on the bottom surface 26*a* of the ring arrangement groove 26.

A pipe 41 having a circular cross section in the direction orthogonal to an axial direction is fixed to the body 21. The pipe 41 is formed of a metal, more preferably, of a stainless steel or the like. The pipe 41 is formed with a shoulder having a small-diameter portion and a large-diameter portion.

The pipe 41 is fixed to the body 21 by press-fitting the small-diameter portion thereof from the head insertion hole 35*b* side into the pipe mounting hole 35*a* of the through hole 35. This fixation is achieved by brazing joint using a metallic brazing material. The brazing material achieves a water-proof function between the pipe 41 and the body 21. The large-diameter portion of the pipe 41 fixed to the body 21 in this manner projects into the head insertion hole 35*b*.

Figure 4:
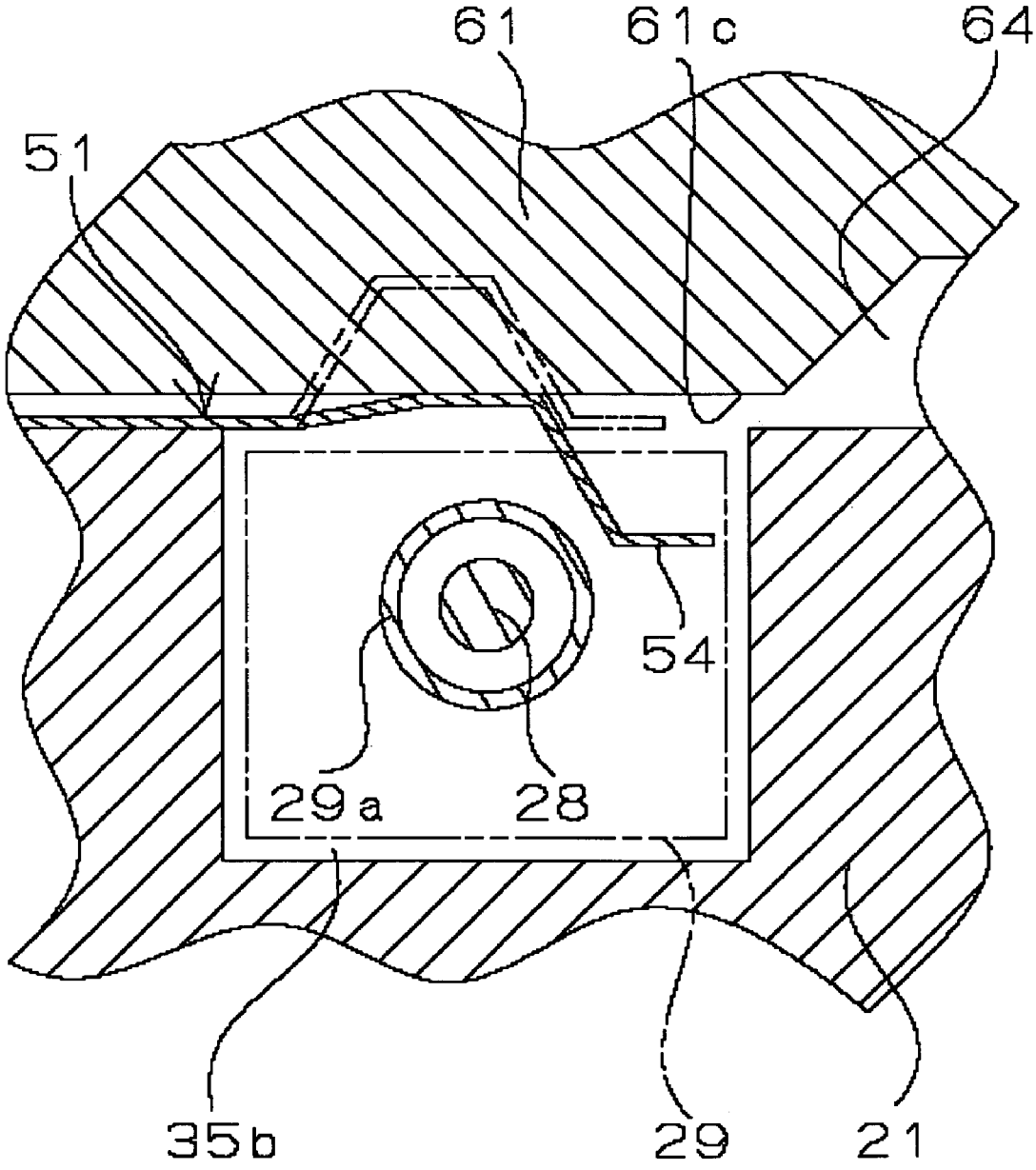
FIG. 4 is a schematic cross-sectional view taken along the line F4-F4 in FIG. 2.

As shown in FIG. 3 and FIG. 4, the push button 27 is formed of a metal or a synthetic resin, and includes a shaft portion 28, an operating head 29, and an engaging portion 30. A distal end (one end) of the shaft portion 28 projecting into the body 21 is configured to push the contact point 16 to move the same by the push button 27 being pushed from the outside of the body (see a double-dashed chain line in FIG. 3).

The cross-section of the shaft portion 28 in the direction orthogonal to the axial direction is a circular shape. The operating head 29 is formed integrally with the other end of the shaft portion 28. The operating head 29 is formed into a shape so as to match the shape of the head insertion hole 35*b*, and has a non-circular shape larger than the shaft portion 28 and, in this embodiment, has a substantially square shape. The engaging portion 30 is formed of a back surface of the operating head 29, for example. Reference numeral 29*a* designates a cylindrical portion projecting integrally from the back surface of the operating head 29 so as to surround the other end portion of the shaft portion 28.

The shaft portion 28 of the push button 27 is inserted into the pipe 41 from the outside of the body, and one end portion of the operating head 29 positioned inside the body 21 is inserted into the head insertion hole 35*b*. In FIG. 2 and FIG. 3, reference numeral 43 designates a water-proof seal ring mounted on the shaft portion 28, and the seal ring 43 is in slidable tight-contact with an inner surface of the pipe 41 in a resiliently deformed state. As shown in FIG. 2 and FIG. 3, a detent member, for example, a stop ring 44 which comes into and out of contact with a distal end of the small-diameter portion of the pipe 41 in association with the axial movement of the push button 27 is mounted at a distal end portion of the shaft portion 28.

A coil spring 45 which is arranged so as to be apart from the back surface of the operating head 29 by the cylindrical portion 29*a* is fitted on the shaft portion 28 and is interposed between the large-diameter portion of the pipe 41 and the back surface of the operating head 29. The coil spring 45 urges the push button 27 in the direction outward-of the body, and the stop ring 44 serves to detent the push button 27 from coming apart due to this urging. In a state in which the push button 27 is positioned by the stop ring 44, the other end portion of the operating head 29 located outside of the body 21 projects from the outer surface 21*a* of the body so as to allow the pushing operation. In association with this, the distal end of the shaft portion 28 is apart from the contact point 16 in this state.

A locking member 51 for preventing the push button 27 from being accidentally pushed inward of the body 21 when the wristwatch 11 is being carried is mounted on the body 21.

The locking member 51 is formed of a metal leaf spring, for example, and includes a proximal portion 52, a plurality of, for example, two mounting portions 53, and stoppers 54 by a number corresponding to the number of the push buttons 27, for example, two as shown in FIG. 6.

Figure 7:
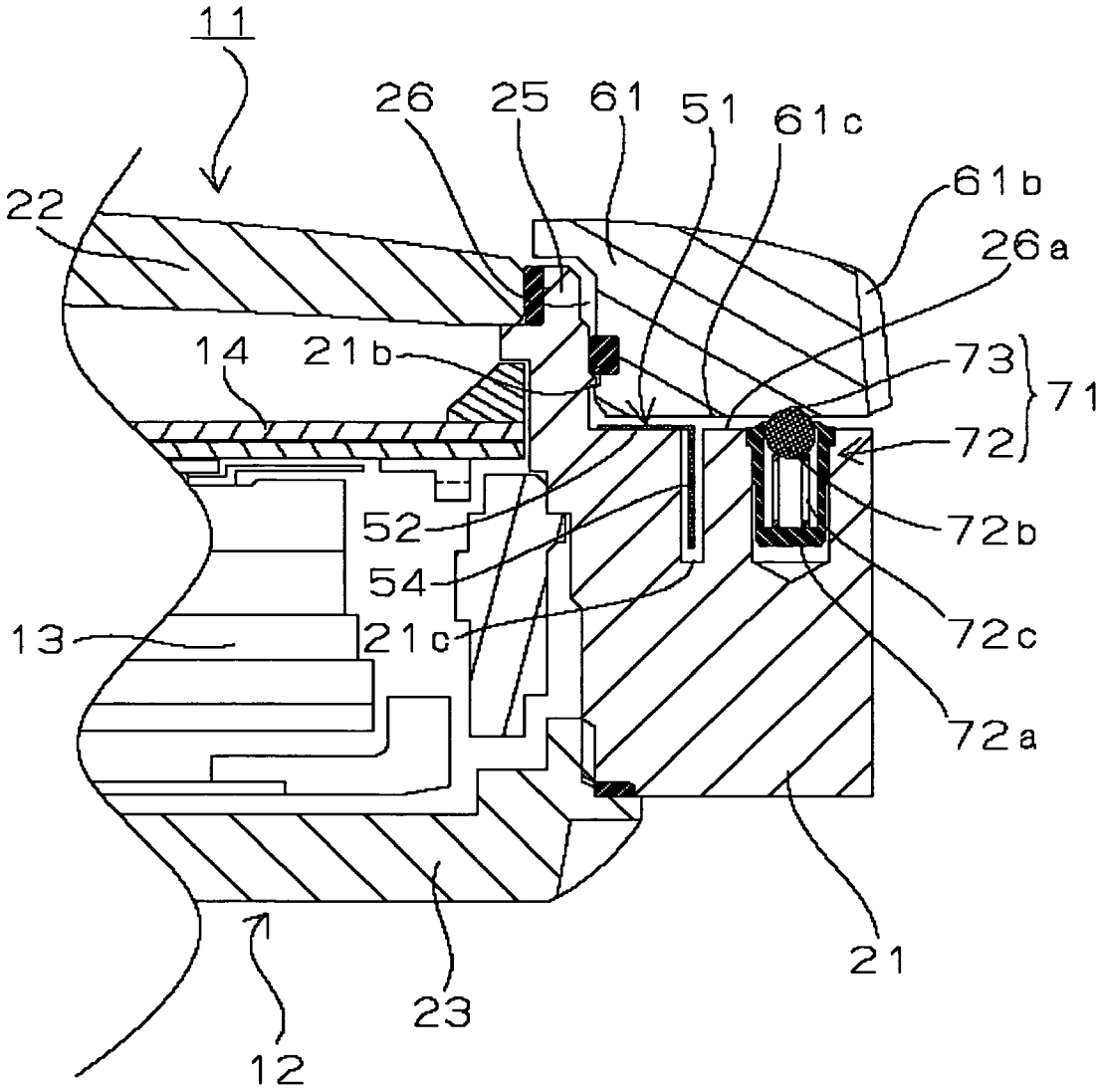
FIG. 7 is a cross-sectional view showing a portion around a click-stop mechanism of the wristwatch in FIG. 1.

The proximal portion 52 is formed into a ring shape having a size to be fitted on the outer periphery of the annular projection 25. The mounting portions 53 are provided apart from each other by 180° and, as shown in FIG. 7, are bent to the back sides thereof from the proximal portion 52. The locking member 51 is fitted to the annular projection 25, and is mounted so as to overlap with the bottom surface 26*a* of the ring arrangement groove 26 by press-fitting the mounting portions 53 into fixing holes 21*c* formed on the body 21 so as to open on the bottom surface 26*a*.

Figure 5:
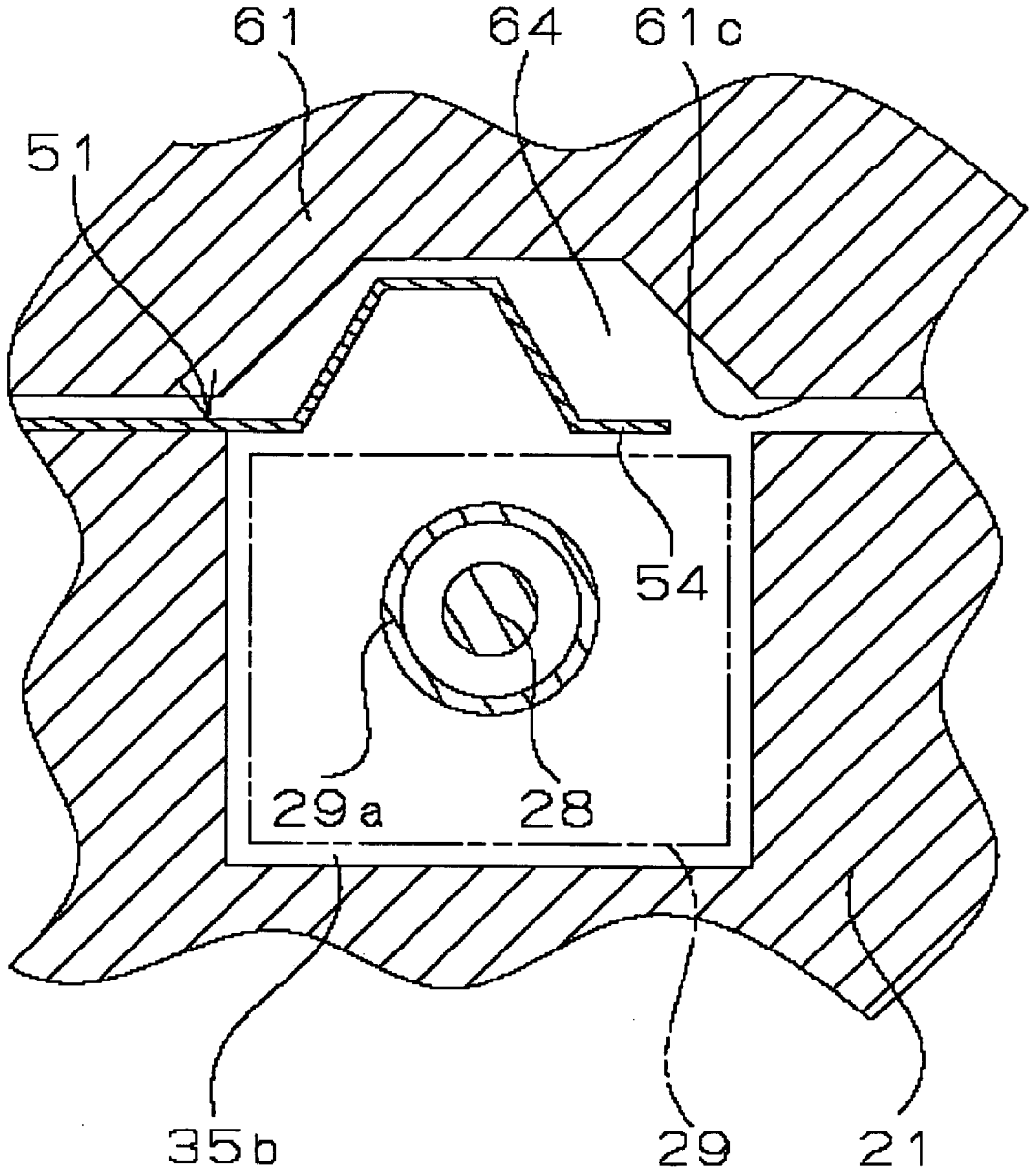
FIG. 5 is a schematic cross-sectional view taken along the line F5-F5 in FIG. 3.

The stoppers 54 each extend integrally outward from the proximal portion 52 in a cantilever state with respect to the proximal portion 52 and are resiliently deformable. The shape of the stopper 54 is a substantially L-shape in plan view as shown in FIG. 6. Also, the portion of the stopper 54 extending so as to follow the proximal portion 52 has a projecting shape in side view, for example, bent upward so as to protrude substantially into a trapezoidal shape as shown in FIG. 5.

The portion of the stopper 54 formed substantially into the trapezoidal shape is arranged right above and in proximity to the communication hole 37 as shown in FIG. 6, and is formed so as to be capable of being inserted into and removed from the head insertion hole 35*b* through the communication hole 37. The stopper 54 is configured to be movable between a locked position at which the stopper 54 is inserted into the head insertion hole 35*b* as shown in FIG. 4 by being resiliently deformed by an operating ring 61, described later, following the rotating operation of the operating ring 61 and an unlocked position at which the stopper 54 is arranged outside the head insertion hole 35*b* as exemplified in FIG. 5. The engaging portion 30 of the push button 27 is engageable with the stopper 54 at the locked position.

The circular operating ring 61 is rotatably arranged in the ring arrangement groove 26 of the watch sheath 12 so as to cover the annular projection 25 and the locking member 51. The operating ring 61 is preferably a continuous ring without discontinuity as shown in the drawing, but may have one discontinuity. Reference numeral 21*b* in FIG. 2 and FIG. 3 shows an annular locking projection formed integrally with an outer peripheral surface of the annular projection 25, and an inner peripheral surface of the operating ring 61 is caught by the annular locking projection 21*b*, whereby the operating ring 61 is prevented from coming apart. Therefore, the operating ring 61 is mounted to the body 21 so as to be rotatably fitted to the outer periphery of the annular projection 25 which surrounds the hour plate 14.

The surface (upper surface) and the peripheral surface of the operating ring 61 are exposed. Reference numerals 61*a*, 61*b* in FIG. 1 designate a plurality of finger stop portions formed on the operating ring 61, and the finger stop portions 61*a*, 61*b* are formed of, for example, recesses and are provided on the peripheral portion of the operating ring 61.

A first display 62 and a second display 63 are provided on the exposed surface of the operating ring 61 as shown in FIG. 1. The first display 62 and the second display 63 are provided so as to correspond to the radial direction of the operating ring 61, and the first display 62 is a character string of "LOCK", and the second display 63 is a character string of "UNLOCK". The first display 62 and the second display 63 are configured to align with, for example, the winder 81 as a mark, but the mark may be provided on the body 21 irrespective of the winder 81.

Figure 8:
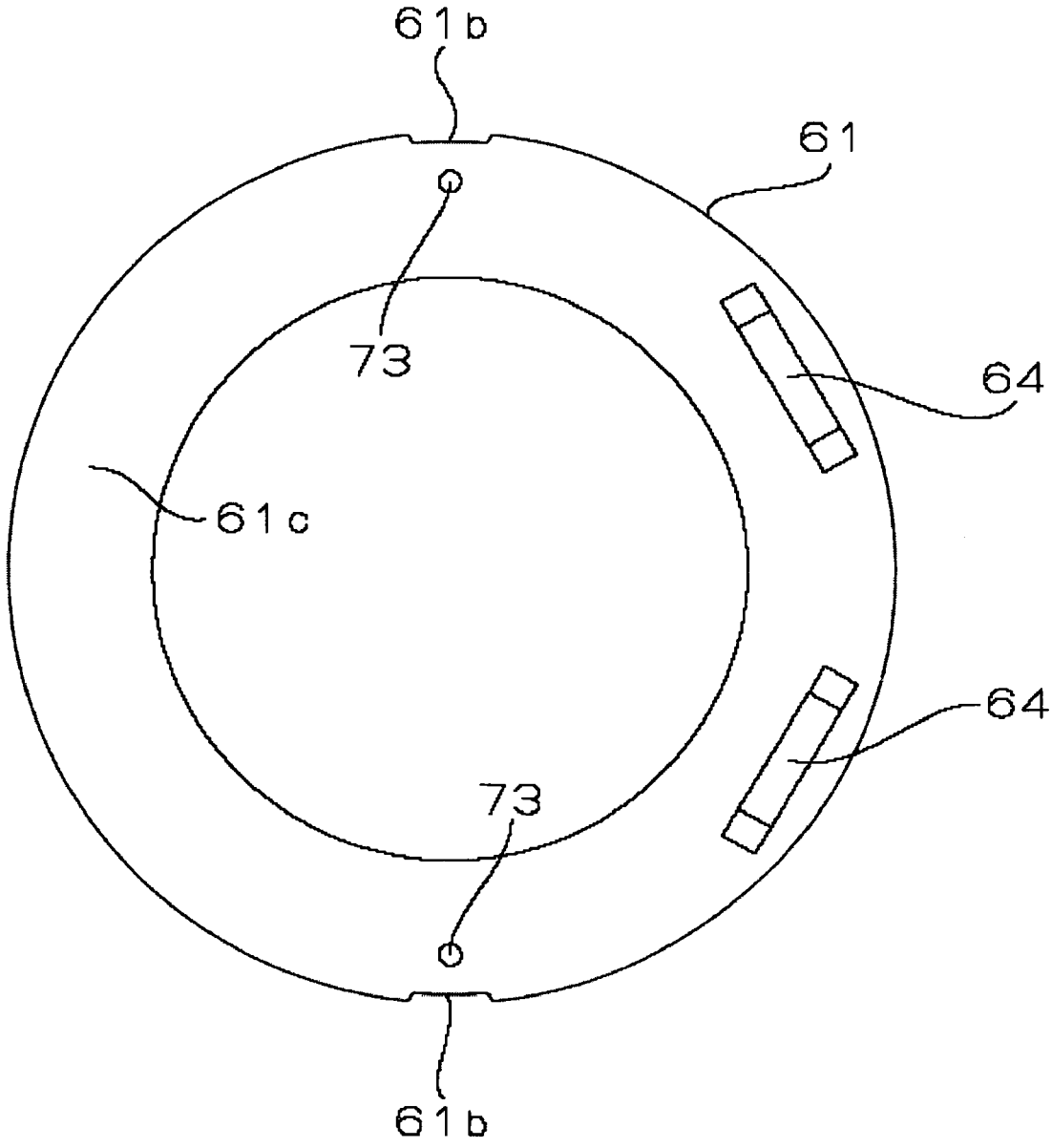
FIG. 8 is a back surface view of the operating ring of the wristwatch in FIG. 1.

As shown in FIG. 8, the operating ring 61 includes a lock surface 61*c* and unlocking recesses 64. The lock surface 61*c* is formed on a back surface of the operating ring 61, which opposes the bottom surface 26*a* of the ring arrangement groove 26 in proximity thereto. The unlocking recesses 64 are provided by the same number as the push buttons 27 so as to open to the lock surface 61*c*. The stopper 54 of the locking member 51 is pressed against the lock surface 61*c* by its own elasticity. The stopper 54 can be inserted into and removed from the unlocking recess 64.

When the lock surface 61*c* of the operating ring 61 is opposed to the communication hole 37, the stopper 54 is pressed downward against its own elasticity by the lock surface 61*c* opposed to the openings thereof as shown in FIG. 2 and FIG. 4, and hence the stopper 54 is pressed into the head insertion hole 35*b* via the communication hole 37 and is held in a state of opposing the engaging portion 30 of the push button 27 from the inside of the body 21 in the proximity thereto.

When the unlocking recess 64 of the operating ring 61 is opposed to the communication hole 37, the stopper 54 is inserted into the unlocking recess 64 as shown in FIG. 3 and FIG. 5 by its own elasticity, so that the stopper 54 is held above the engaging portion 30 of the push button 27 in a state of being disengaged therefrom.

The locking member 51 and the operating ring 61 constitute locking means configured to position the push button 27 having the engaging portion 30 at a predetermined position and hold the same in the locked state when not in use, and be able to release this locked state when the push button 27 is to be operated.

The wristwatch 11 includes, for example, a pair of click-stop mechanisms 71 shown in FIG. 7. The click-stop mechanisms 71 each include a mechanism portion 72 and a stop recess 73.

As shown in FIG. 6, the mechanism portions 72 are mounted on the body 21, for example, on a line passing through 12 o'clock and 6 o'clock. The mechanism portions 72 each includes a cylindrical holder 72*a* embedded in the body 21, a rotatable steel ball 72*b* supported by the holder 72*a* so as to be movable in the vertical direction and not to come apart upward, and a spring 72*c* stored in the holder 72*a* and configured to urge the steel ball 72*b* upward as shown in FIG. 7. Upper portions of the steel balls 72*b* project from the bottom surface 26*a* of the ring arrangement groove 26.

The stop recesses 73 are formed on the operating ring 61 by 180° apart from each other so as to open on the lock surface 61*c* which constitutes the back surface of the operating ring 61, as shown in FIG. 8. The steel balls 72*b* are disengageably engageable with the stop recesses 73.

In a state in which the operating ring 61 is rotated so that the first display 62 is aligned with the winder 81, the steel ball 72*b* engages the stop recess 73 and hence the operating ring 61 is temporarily held, and in this temporarily held state, the stopper 54 of the locking member 51 is pressed downward by the lock surface 61*c* of the operating ring 61 and arranged at locked position. Also, in a state in which the operating ring 61 is rotated to a position in which the second display 63 is aligned with the winder 81, the stopper 54 of the locking member 51 rises by its own elasticity and engages the unlocking recess 64 so as to assume the unlocked state. In association with this rotating operation, the stop recess 73 engages the steel ball 72*b* and hence the operating ring 61 is temporarily held. However, the still ball which is engaged in this case is the steel ball 72*b* of the click-stop mechanism 71 arranged apart by 180° from the steel ball 72*b* which used to be engaged till then.

In a state in which the push button 27 of the wristwatch 11 configured as described above is not used such as when being carried, the stopper 54 of the locking member 51 is arranged at the locked positions as shown in FIG. 2 and FIG. 4 in order to prevent the push button 27 from being pressed accidentally inward of the body 21. This locked state is achieved by rotating the operating ring 61 and aligning the first display 62 on the surface thereof with the winder 81.

When the stopper 54 of the locking member 51 is adequately arranged at the locked position by the rotation of the operating ring 61, at this moment, the click-stop mechanism 71 performs a click-stop operation to temporarily hold the operating ring 61. In this case, the user is notified that the stopper 54 of the locking member 51 is placed at the locked position by the feeling of detent provided by the click-stop operation and the sounds generated in association with the detent.

In the locked state, since the lock surface 61*c* of the operating ring 61 presses the stopper 54 of the locking member 51, the stopper 54 is pressed downward against its own elasticity about its root, and is arranged at the locked position shown by a solid line in FIG. 2 and in FIG. 4.

The engaging portion 30 of the push button 27 opposes the stopper 54 of the locking member 51 arranged at the locked position at close range from the outside of the body 21. Therefore, when a pushing force acts accidentally on the push button 27 in the locked state by an impact applied when the wristwatch 11 falls, the engaging portion 30 of the push button 27 is caught by the stopper 54 of the locking member 51 immediately. The push button 27 is restrained from moving from the predetermined position by such engagement and erroneous operation such that the push button 27 is accidentally pressed inward is prevented.

In the prevention of the erroneous operation, since the engaging portion 30 is caught by the side end surface of the stopper 54 in terms of the widthwise direction instead of the surface in terms of the thickness direction, the stopper 54 is hardly deformed in comparison with the case where the pressing force is received by the surface of the stopper 54 in terms of the thickness direction. Therefore, the reliability of the prevention of the erroneous operation is high.

When it is necessary to operate the push button 27, first of all, the operating ring 61 is rotated by 180° from the state shown by a solid line in FIG. 2 and in FIG. 4 and the second display 63 is aligned with the winder 81 to move the stoppers 54 of the locking member 51 to the unlocked position, and then the pushing operation of the push button 27 is performed.

By the rotation of the operating ring 61 as described above, the lock surface 61*c* is released from the stopper 54 of the locking member 51, and the unlocking recess 64 of the operating ring 61 opposes the stopper 54. Therefore, the stopper 54 rises by its own elasticity and enters the unlocking recess 64, and is arranged in the unlocked position. In association with this, the stopper 54 is released upward so as not to oppose the engaging portion 30 of the push button 27, whereby a state of allowing the pushing operation of the push button 27 is assumed.

In this case as well, the stoppers 54 of the locking member 51 enter the unlocking recesses 64 by their own elasticity, and the click-stop operation similar to that of the click-stop mechanism 71 is achieved. Therefore, the user is notified that the stopper 54 of the locking member 51 is placed at the unlocked position by the feeling of detent provided by this operation and the sounds generated in association with the detent.

By pushing the push button 27 in the unlocked state as described above, the push button 27 can be moved inward of the body 21 from the predetermined position shown in FIG. 2 and by a solid line in FIG. 3. Accordingly, the contact point 16 is pressed by the pushbutton 27, and a predetermined function provided to the contact point 16 can be performed.

The circular operating ring 61 rotatably mounted on the watch sheath 12 as described above functions as a cam, and the stoppers 54 of the locking member 51 pressed against the cam surface (the lock surface 61*c* and the unlocking recesses 64 continued therefrom) by their own elasticity follows. Therefore, by rotating the operating ring 61 from the front side of the watch sheath 12, the stoppers 54 of the locking member 51 can be arranged in the locked position or the unlocked position in conjunction therewith.

Since the operating ring 61 surrounds the hour plate 14 mounted on the watch sheath 12, it is much larger than the push button 27 which is pressed from the side of the body 21. Therefore, the operating ring 61 can easily be rotated by gripping the same. In addition, since the operating ring 61 is operated from the front side of the watch sheath 12, even though the wristwatch 11 is worn on the wrist of the user, the operation is rarely hindered by the wrist.

Therefore, the operation to restrain the push button 27 from being moved accidentally when not in use and the operation to release this restraint are easily achieved.

In addition, since the first embodiment is configured to hinder the pushing operation of the push button 27 using the stopper 54 of the locking member 51 arranged at the locked position, the operating ring 61 interlocked with the stopper 54 and the push button 27 are arranged at separate positions, so that the push button 27 does not constrain the rotation of the operating ring 61. Therefore, the push button 27 can be formed into a square shape in front view as exemplified in the first embodiment. The shape of the push button 27 may be a circular shape in front view and, instead, it can be formed into arbitrary non-circular shapes other than the square shape. Therefore, it is preferable in that the flexibility in design of the wristwatch 11 can be enhanced.

In the configuration according to the first embodiment, the elasticity of the stoppers 54 by themselves is utilized to maintain the state in which the stoppers 54 of the locking member 51 are in elastic contact with the cam surface of the operating ring 61. Therefore, the number of components which constitute the locking means is preferably reduced.

In addition, according to the configuration of the first embodiment, since the mutual engagement of the threads as in the related art is not necessary, a load directed outward of the body is not applied on the push button 27 when the stoppers 54 of the locking member 51 are arranged at the locked position. In addition, since the load directed outward of the body with respect to the push button 27 is not gradually increased even by increase in the number of times of rotation of the operating ring 61, security is ensured. Also, in the configuration in which the mutual engagement of the threads as in the related art is utilized, if the locking member is excessively rotated when the locking member is moved to the locked position, the push button might come apart outward of the body. Also, since the mutual engagement of the threads as in the related art is not necessary, it is easy to machine. In other words, since the locking member 51 can easily be obtained by punching by a press work, and the machining of the operating ring 61 is also easy, good manufacturability is achieved.

FIG. 9 to FIG. 14 show a second embodiment of the present invention. Since this embodiment is the same as the first embodiment other than those described below, the same components as the first embodiment are designated by the same reference numerals and the description will be omitted.

The second embodiment is different from the first embodiment in that the winder 81 as the push-pull operating member is restrained so as not to move from the predetermined position by the locking means when not in use, and the restraint is releasable when the winder 81 is operated. In this embodiment, only one locking means is provided corresponding to the winder 81, and the locking means for the push button is omitted. Furthermore, the second embodiment is different from the first embodiment in that the click-stop mechanism for positioning the operating ring 61 in the state in which the stopper 54 of the locking member 51 is arranged in the locked position and the unlocked position is configured using the locking member instead of the click-stop mechanism described in the first embodiment.

More specifically, the winder 81 includes a shaft portion 82 and an operating head 83, for example, integrally continued therefrom, and the shaft portion 82 is connected to the watch movement 13 via a setting stem 84 connected thereto.

The operating head 83 is larger in diameter than the shaft portion 82, and serration 83*a* for reducing probability of slip of fingers of the user who holds the operating head 83 to rotate the same is formed on a periphery thereof by spline machining. In addition, an engaging portion 85 formed into an annular recess is formed on the outer periphery of the operating head 83 so as to extend across the serration 83*a*.

Figure 9:
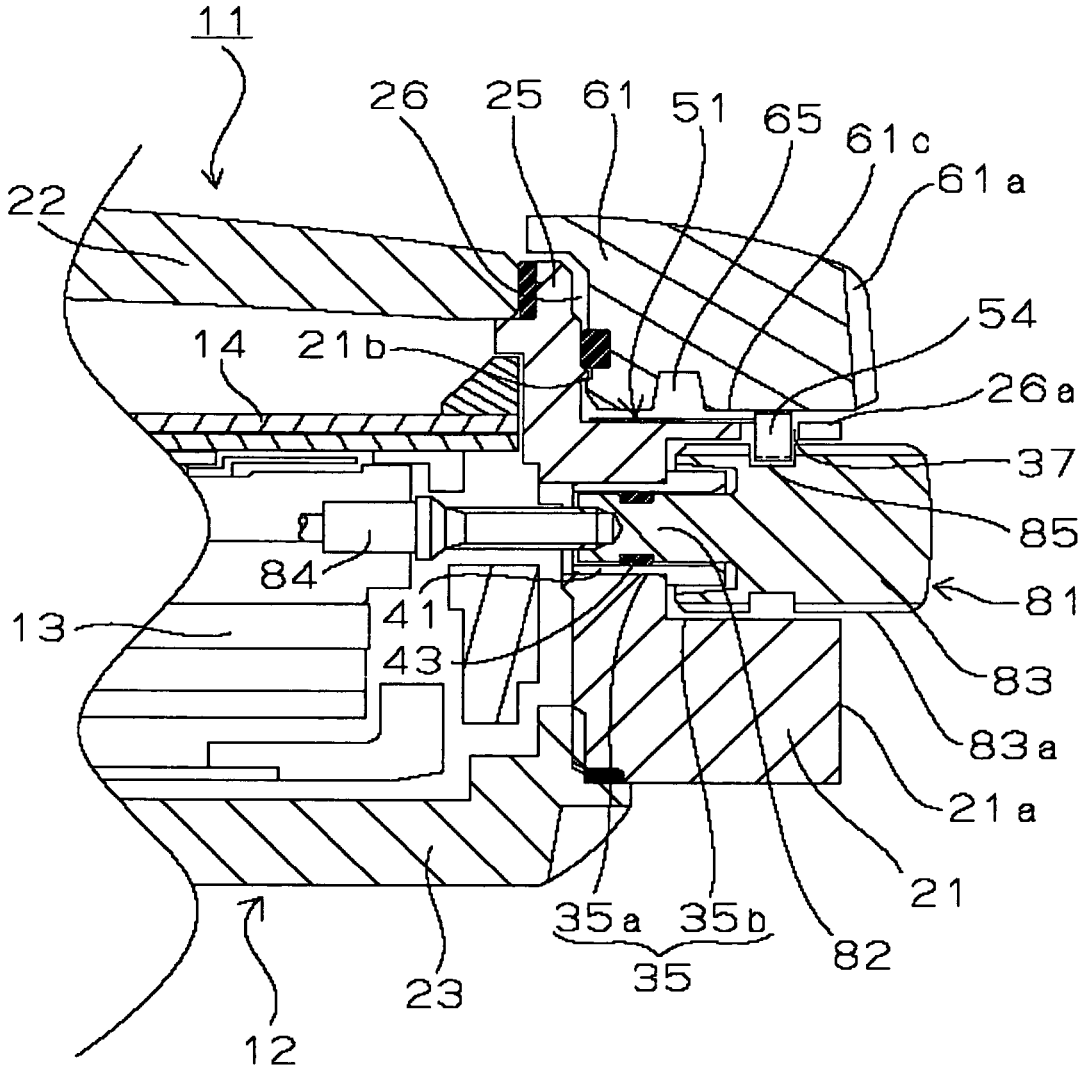
FIG. 9 is a cross-sectional view of a winder mounting portion of the wristwatch according to a second embodiment of the present invention in a state in which a winder is locked.

Therefore, in the wristwatch 11 according to the second embodiment, in a state in which the winder 81 is not used such as the case of being carried, the stopper 54 of the locking member 51 is arranged at the locked position in which the unintended pulling of the winder 81 outward and sideward of the body 21 is prevented as shown in FIG. 9.

In a state in which the winder 81 is locked by the locking means, the lock surface 61*c* of the operating ring 61 is in contact with the stopper 54 of the locking member 51, and the stopper 54 is pushed downward against its own elasticity and is arranged in the locked position shown in FIG. 9. The stopper 54 of the locking member 51 arranged at this locked position is fitted into the engaging portion 85 which is a recess formed on the winder 81.

Therefore, when a pulling force acts accidentally on the winder 81 in the locked state, the stopper 54 of the locking member 51 is caught by the wall surface of the recess which forms the engaging portion 85 immediately from the inner side of the body 21. With such engagement, the winder 81 is restrained from moving from the predetermined position, and the erroneous operation that the winder 81 is accidentally pulled out is prevented.

When it is necessary to operate the winder 81, first of all, the operating ring 61 is rotated by 180° from the state shown in FIG. 9, and the second display 63 (see FIG. 1) is aligned to the winder 81 to move the stopper 54 of the locking member 51 to the unlocked position, and then, the winder 81 is pulled out and rotated.

By the rotation of the operating ring 61, the lock surface 61*c* is released from the stopper 54 of the locking member 51, and the unlocking recess 64 of the operating ring 61 opposes the stopper 54. Therefore, the stopper 54 rises by its own elasticity and enters the unlocking recess 64, and is arranged in the unlocked position (see FIG. 10). In association with this, the stopper 54 is released and moved upward of the engaging portion 85 of the winder 81, and the state of allowing the pulling operation of the winder 81 is achieved.

Figure 10:
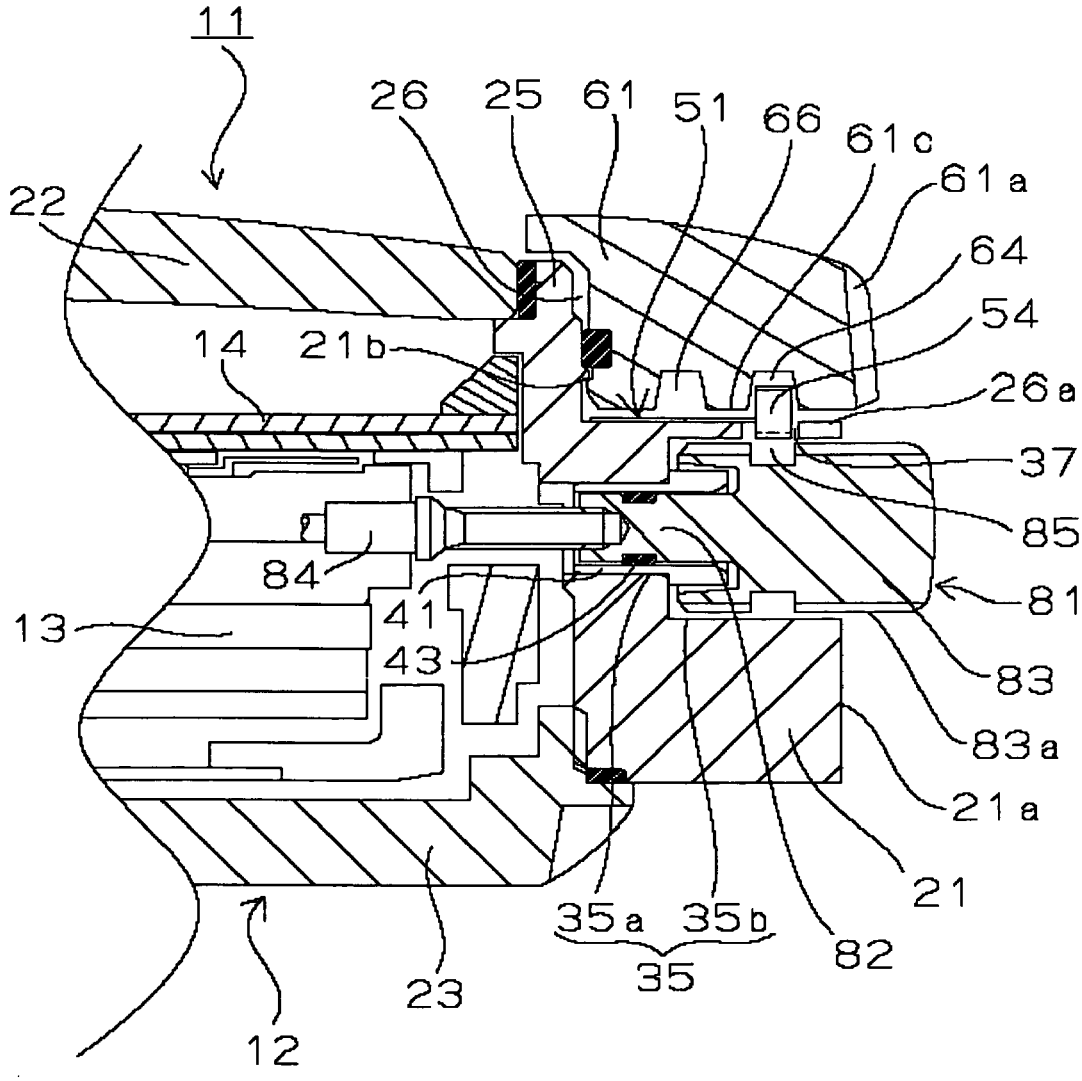
FIG. 10 is a cross-sectional view showing the winder mounting portion of the wristwatch according to the second embodiment in a state in which the lock of the winder is released.

Therefore, the winder 81 can be pulled out from the predetermined position shown in FIG. 9 and FIG. 10 in the axial direction in this unlocked state, so that the winder 81 can be rotated to adjust the time of the day or the date. Therefore, according to the second embodiment as well, the problem of the present invention can be solved.

Figure 11:
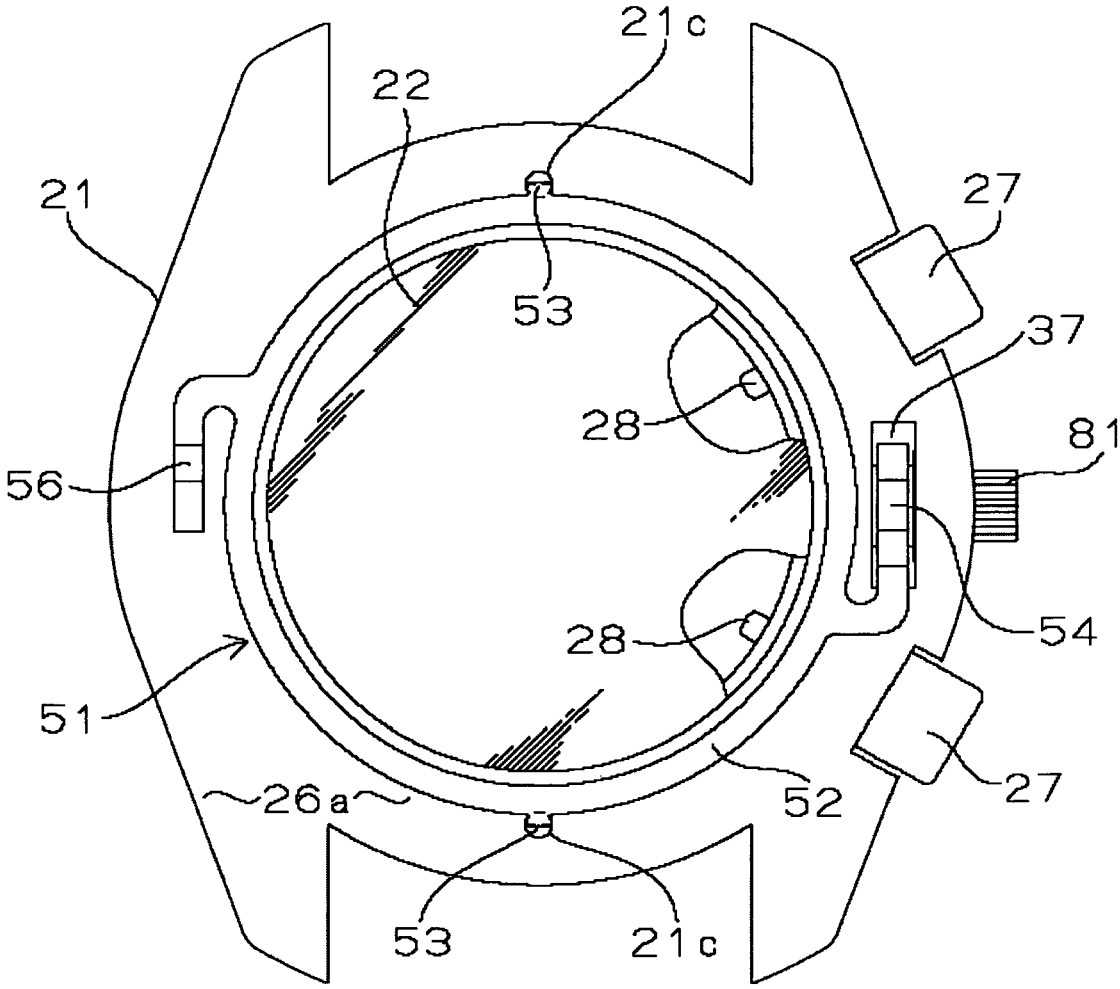
FIG. 11 is a front view, partly broken, of the wristwatch according to the second embodiment in a state in which the operating ring thereof is removed.
Figure 13:
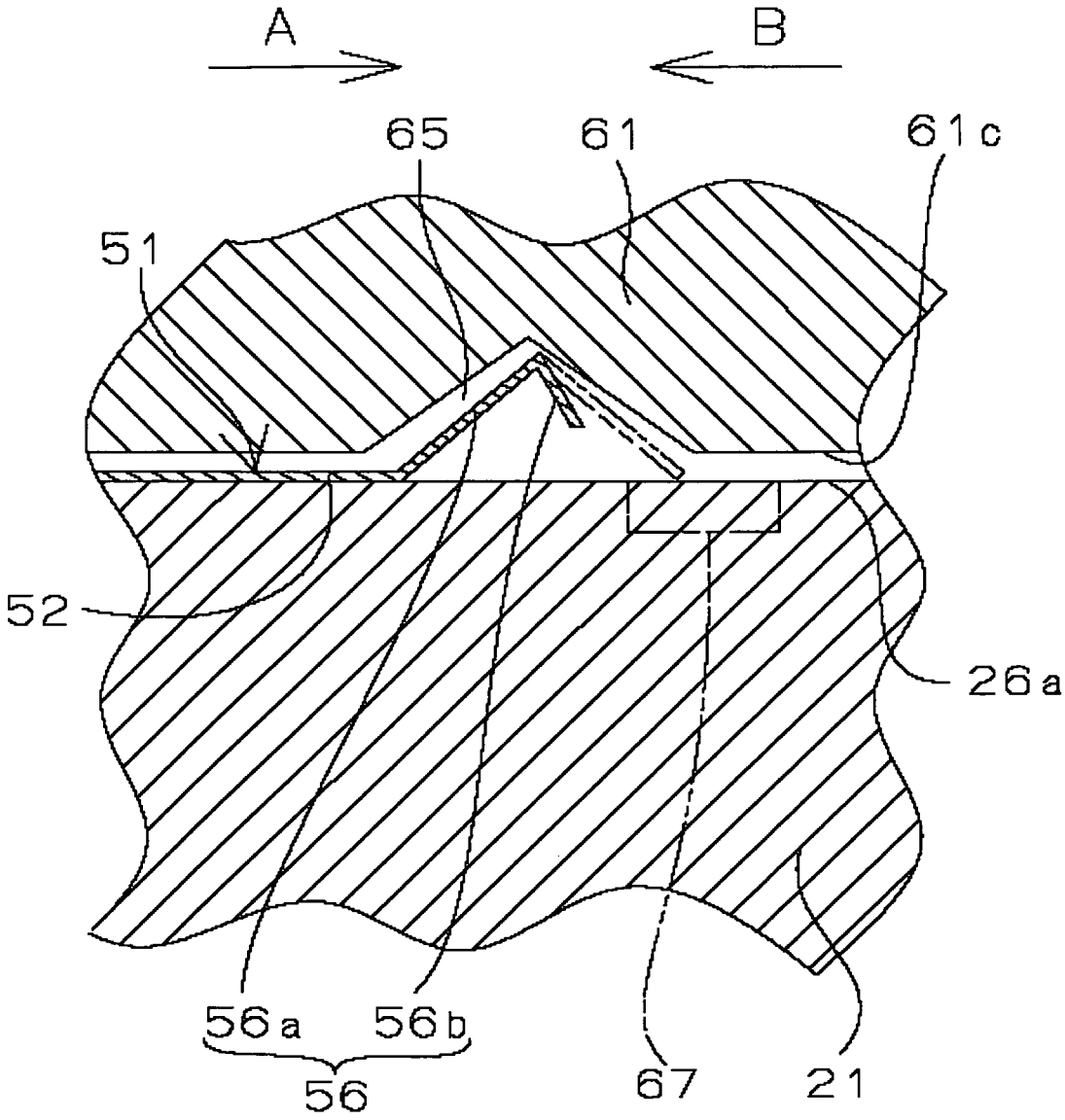
FIG. 13 is a schematic cross-sectional view taken along the line F13-F13 in FIG. 12.

As shown in FIG. 11, the locking member 51 includes a detent strip 56 at a position different from the stopper 54, for example, at a position 180° apart from the stopper 54. The detent strip 56 extends integrally outward from the proximal portion 52 in a cantilever state with respect to the proximal portion 52 and is resiliently deformable. The shape of the detent strip 56 is a substantially L-shape in plan view as shown in FIG. 11. Accordingly, the portion of the detent strip 56 extending along the proximal portion 52 is formed into a substantially V-shape with an inclined portion 56*a* projecting upward, that is, toward the operating ring 61 and a locking portion 56*b* bent in an arcuate angle downward from the distal end thereof as shown in FIG. 13. The locking portion 56*b* is shorter than the inclined portion 56*a*, and the locking portion 56*b* is elastically deformable until the distal end of the locking portion 56*b* comes into contact with the bottom surface 26*a*, whereby the rotation of the operating ring 61 is allowed.

Figure 12:
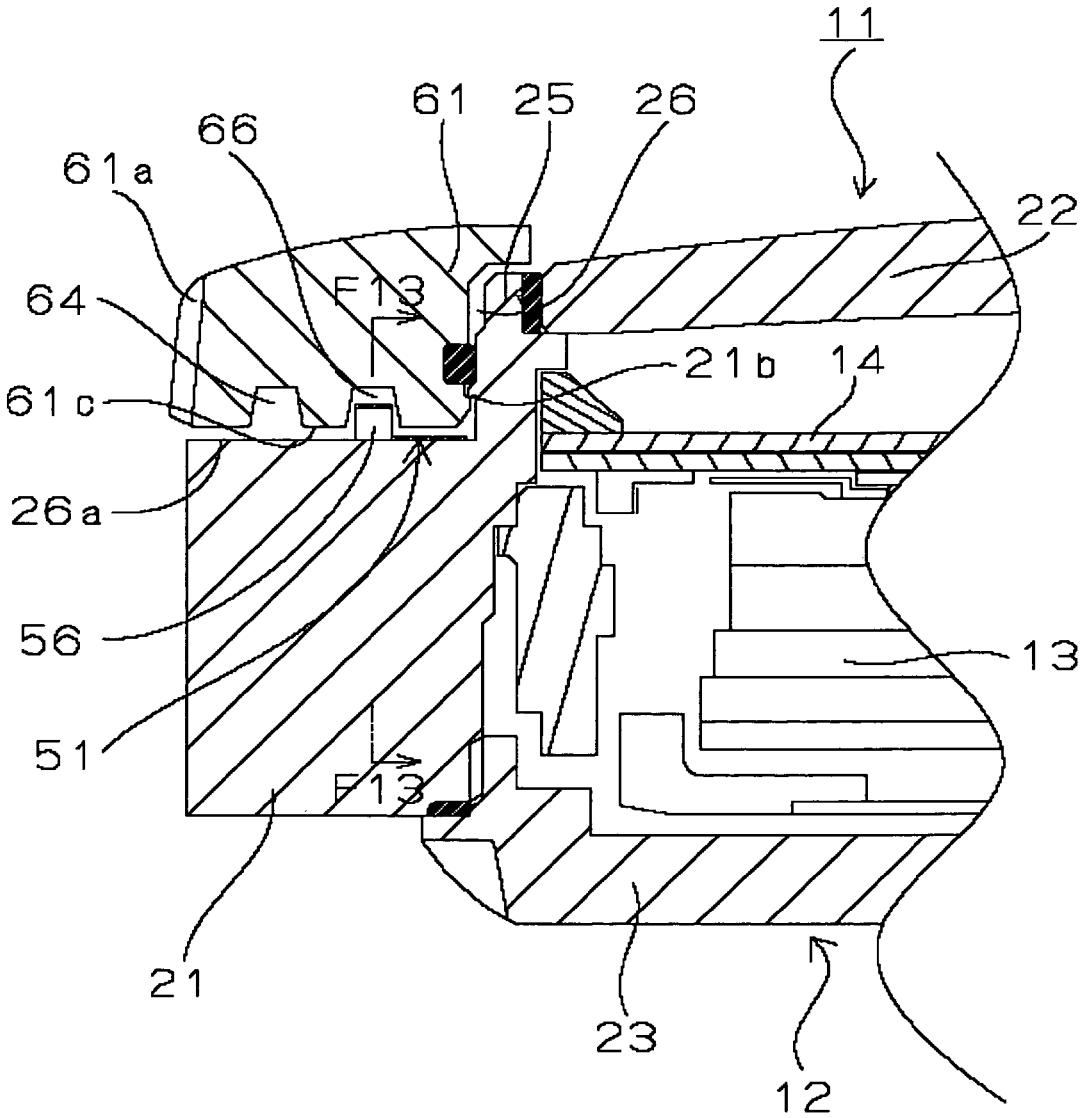
FIG. 12 is a cross-sectional view showing a configuration in which a detent is provided to the rotation of the operating ring of the wristwatch according to the second embodiment.
Figure 14:
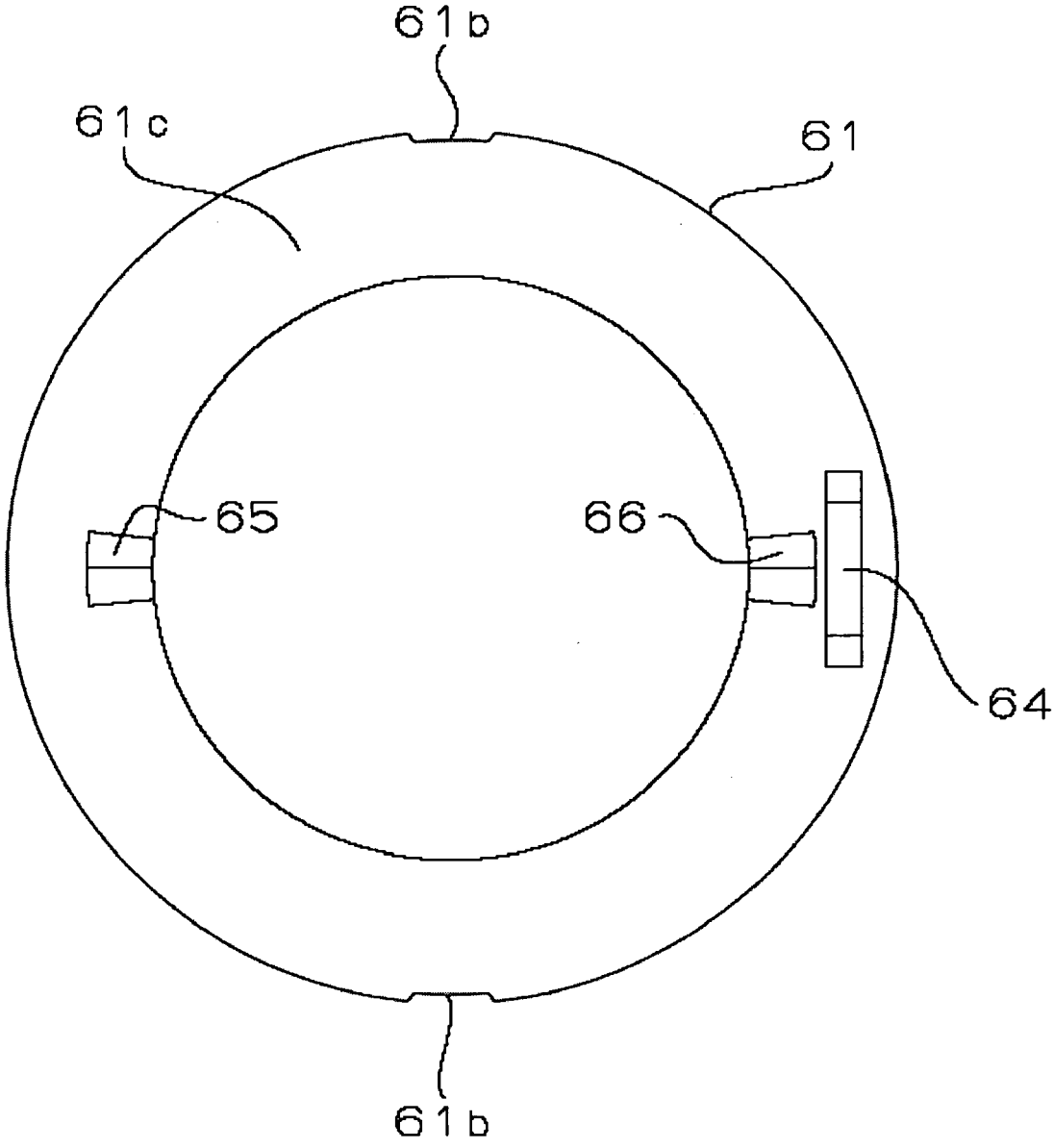
FIG. 14 is a back surface view of the operating ring of the wristwatch according to the second embodiment.

As shown in FIG. 12 to FIG. 14, the operating ring 61 is provided with a first detent groove 65 and a second detent groove 66 for allowing insertion and removal of the detent strip 56 in association with the rotation of the operating ring 61 so as to open toward the lock surface 61*c*. These detent grooves 65, 66 are formed into a V-shape as shown in FIG. 13 as a representative. The first detent groove 65 and the second detent groove 66 are provided apart from each other by 180°.

The first detent groove 65 is apart from the unlocking recess 64 by 180°, and the detent strip 56 is engaged with the first detent groove 65 in a state in which the stopper 54 is arranged at the unlocked position. The second detent groove 66 and the unlocking recess 64 are arranged side by side close to each other and the detent strip 56 is engaged with the second detent groove 66 in a state in which the stopper 54 is arranged at the locked position.

Therefore, by rotating the operating ring 61, the stopper 54 is arranged at the locked position as shown in FIG. 9 and, simultaneously, the second detent groove 66 opposes the detent strip 56 so as to cover the same as shown in FIG. 12. Therefore, the detent strip 56 rises by its own elasticity, and engages the second detent groove 66 so that the operating ring 61 is temporarily held. The user is notified that the stoppers 54 of the locking member 51 is placed at the locked position by, the feeling of detent provided by the click-stop operation and the sounds generated in association with the detent as described above.

In contrast, by rotating the operating ring 61, the stopper 54 is arranged at the unlocked position as shown in FIG. 10 and, simultaneously, the first detent groove 65 opposes the detent strip 56 so as to cover the same. Therefore, the detent strip 56 rises by its own elasticity, and engages the first detent groove 65 so that the operating ring 61 is temporarily held. In the click-stop action at this time, the user is notified that the stopper 54 of the locking member 51 is placed at the unlocked position.

As described above, every time when the operating ring 61 is rotated by 180°, the operating ring 61 is temporarily held by the click-stop action. The detent strip 56 which is in charge of the temporary holding is formed integrally with the locking member 51, a component specific as the detent strip can be eliminated, so that the simple configuration is achieved.

When the operating ring 61 is rotated in the direction indicated by an arrow A in FIG. 13, the detent strip 56 is elastically deformed so as to lie down and gets close to the bottom surface 26*a*, so that the first detent groove 65 and the second detent groove 66 can pass over the detent strip 56. In contrast, when the operating ring 61 is rotated in the direction indicated by an arrow B of a broken line in FIG. 13, the detent strip 56 is elastically deformed to a direction to get upward from the bottom surface 26*a* and, immediately after that, the detent strip 56 bridges in the first detent groove 65 or the second detent groove 66, so that the rotation of the operating ring 61 in the direction indicated by the arrow B is prevented. Accordingly, the operating ring 61 can only be rotated in one direction and cannot be rotated in the opposite direction.

As indicated by the doubled-dashed chain line in FIG. 13, when the V-shaped detent strip 56 is configured to have inclined portions substantially of the same length, and an undercut 67 which allows the displacement of the inclined portion on a free end side thereof is formed on the body 21 so as to open from the bottom surface 26*a*, the both-way rotation of the operating ring 61 is enabled.

The configurations of the second embodiment other than those described above are the same as in the first embodiment including the configurations which are not shown in FIG. 9 to FIG. 14. Since other actions are the same as those in the first embodiment, the description will be omitted.

The present invention is not limited to the respective embodiments as described above, and may be applied to portable devices such as stop watches, mobile phones, portable information terminals in addition to the portable watches.

What is claimed is:

1. A portable device comprising:

an operating member having an engaging portion and being slidably mounted on a device sheath; a stopper movable between a locked position in which the operating member is restrained at a predetermined position by engagement of the stopper with the engaging portion and an unlocked position in which a sliding operation of the operating member relative to the stopper is allowed, the stopper being arranged on the device sheath; and a circular operating ring surrounding a display portion mounted on the device sheath and being mounted on the device sheath from the front side thereof so as to allow a rotating operation, wherein the movement of the stopper between the locked position and the unlocked position is interlocked with the rotating operation of the operating ring, and wherein a push-pull winder of the portable watch constitutes the operating member, and the pulling operation of the winder is prevented by the stopper arranged at the locked position.

2. A portable watch configured with the portable device according to claim 1.

3. A portable device comprising: an operating member having an engaging portion and being slidably mounted on a device sheath; a stopper movable between a locked position in which the operating member is restrained at a predetermined position by engagement of the stopper with the engaging portion and an unlocked position in which a sliding operation of the operating member relative to the stopper is allowed, the stopper being arranged on the device sheath; and a circular operating ring surrounding a display portion mounted on the device sheath and being mounted on the device sheath from the front side thereof so as to allow a rotating operation, wherein the movement of the stopper between the locked position and the unlocked position is interlocked with the rotating operation of the operating ring, wherein the operating member is a push button, and the pushing operation of the push button is prevented by the stopper arranged at the locked position, and wherein the stopper is a leaf spring.

4. A portable device comprising: an operating member having an engaging portion and being slidably mounted on a device sheath; a stopper movable between a locked position in which the operating member is restrained at a predetermined position by engagement of the stopper with the engaging portion and an unlocked position in which a sliding operation of the operating member relative to the stopper is allowed, the stopper being arranged on the device sheath; and a circular operating ring surrounding a display portion mounted on the device sheath and being mounted on the device sheath from the front side thereof so as to allow a rotating operation, wherein the movement of the stopper between the locked position and the unlocked position is interlocked with the rotating operation of the operating ring, wherein the operating member is a push button, and the pushing operation of the push button is prevented by the stopper arranged at the locked position, and wherein the stopper includes an elastically deformable detent strip projecting toward the operating ring at a position different from the stopper, and the operating ring is provided on the back surface thereof with a detent groove which allows the detent strip to be inserted therein and removed therefrom in association with the rotation of the operating ring and allows the detent strip to be engaged therewith in a state in which the stopper is arranged at the locked position.

5. A portable device comprising: an operating member having an engaging portion and being slidably mounted on a device sheath; a locking member having an elastically deformable stopper movable between a locked position in which the operating member is restrained at a predetermined position by engagement of the stopper with the engaging portion and an unlocked position in which a sliding operation of the operating member is allowed, the stopper being arranged on the device sheath; and a circular operating ring surrounding a display portion mounted on the device sheath and being mounted on the device sheath from the front side thereof so as to allow a rotating operation, wherein the stopper is brought into contact with a back surface of the operating ring so that the movement of the stopper between the locked position and the unlocked position is interlocked with the rotating operation of the operating ring.

6. The portable device according to claim 5; wherein the operating member is a push button, and the pushing operation of the push button is prevented by the stopper arranged at the locked position.

7. A portable device according to claim 6; wherein the shape of the operating head of the push button in front view is a non-circular shape.

8. A portable device according to claim 6; wherein the locking member is a leaf spring.

9. A portable device according to claim 6; wherein the locking member includes an elastically deformable detent strip projecting toward the operating ring at a position different from the stopper, and the operating ring is provided on the back surface thereof with a detent groove which allows the detent strip to be inserted therein and removed therefrom in association with the rotation of the operating ring and allows the detent strip to be engaged therewith in a state in which the stopper is arranged at the locked position.

10. A portable device according to claim 6; further comprising a click-stop mechanism configured to temporarily hold the operating ring in a state in which the stopper is arranged at the locked position.

11. A portable device comprising:

a device sheath having a through-hole and a communication hole communicating with the through-hole;

a display portion mounted on the device sheath;

a pipe inserted into the through-hole and fixed to the device sheath, an operating member having a shaft portion slidably inserted into the pipe, an operating head provided at one end of the shaft portion and inserted into the through-hole, and an engaging portion formed on the operating head;

a circular operating ring surrounding the display portion and having a locking surface which can oppose the communication hole and an unlocking recess opening on the locking surface, the circular operation ring being rotatably mounted on the device sheath from the front side of the sheath; and a locking member mounted on the device sheath and having a stopper that is movable between a locked position which allows engagement of the engaging portion and an unlocked position in which the stopper is apart from the engaging portion by being elastically deformed according to the locking surface and the unlocking recess and inserted into or removed from the through-hole via the communication hole in association with the elastic deformation.

12. The portable device according to claim 11; wherein the operating member is a push button, and the pushing operation of the push button is prevented by the stopper arranged at the locked position.

13. A portable device according to claim 12; wherein the locking member is a leaf spring.

14. A portable device according to claim 12; wherein the locking member includes an elastically deformable detent strip projecting toward the operating ring at a position different from the stopper, and the operating ring is provided on the back surface thereof with a detent groove which allows the detent strip to be inserted therein and removed therefrom in association with the rotation of the operating ring and allows the detent strip to be engaged therewith in a state in which the stopper is arranged at the locked position.

15. A portable device according to claim 12; further comprising a click-stop mechanism configured to temporarily hold the operating ring in a state in which the stopper is arranged at the locked position.

16. A portable device according to claim 12; wherein the shape of the operating head of the push button in front view is a non-circular shape.

* * * * *